United States Patent [19]

Miura

[11] Patent Number: 4,572,405

[45] Date of Patent: Feb. 25, 1986

[54] CONTROL SYSTEM FOR CONTROLLING A SUPPLY OF FLUID TO AN INTEGRAL QUANTITY

[75] Inventor: Yukio Miura, Yokohama, Japan

[73] Assignee: Tokico Ltd., Kanagawa, Japan

[21] Appl. No.: 641,841

[22] Filed: Aug. 17, 1984

[30] Foreign Application Priority Data

Aug. 19, 1983 [JP] Japan ..... 58-151867

[51] Int. Cl.[4] ..... B67D 5/30

[52] U.S. Cl. ..... 222/14; 222/642; 222/333; 364/479; 377/21

[58] Field of Search ..... 222/14–16, 222/22, 59, 63, 638, 639, 642, 643, 71, 36, 37, 333; 377/21; 364/479

[56] References Cited

U.S. PATENT DOCUMENTS

| | | | |
|---|---|---|---|
| 3,773,219 | 11/1973 | Irie et al. | 222/14 X |
| 3,887,110 | 6/1975 | Porter | 222/16 |
| 3,907,165 | 9/1975 | Carbone | 222/16 |
| 4,222,448 | 9/1980 | Sunkle et al. | 177/1 |
| 4,254,328 | 3/1981 | Murray et al. | 235/92 PE |
| 4,354,620 | 10/1982 | Tsuneda et al. | 222/14 |
| 4,360,127 | 11/1982 | Maruyama et al. | 222/14 |
| 4,442,953 | 4/1984 | Miyamoto et al. | 222/14 |

*Primary Examiner*—Joseph J. Rolla
*Assistant Examiner*—Michael S. Huppert
*Attorney, Agent, or Firm*—Michael N. Meller

[57] ABSTRACT

A control system for controlling a supply of fluid to an integral quantity, and automatically and precisely supplying an integral quantity of fluid. When an operation is performed so as to stop the supply of fluid at the point when the quantity of supplied fluid reaches the integral quantity, the driving of a pump is once interrupted. Thereafter, the pump is repeatedly driven in terms of minute time periods, so that the fluid supplying operation is stopped at the point when the quantity of fluid which is finally supplied is equal to the integral quantity which is closest to a quantity of supplied fluid at the point when the driving of the pump was once interrupted.

4 Claims, 8 Drawing Figures

50
WAITING STATE
D
51
SW 30 LOW MANIP ?
NO
YES
ROTATE ELEV MOTOR LOW
52
53
NOZZLE 24 AT POSITION B ?
NO
YES
CUT OFF CURR TO ELEV MOTOR
54
APPLY CURR TO MOTOR 26
55
CLEAR INDIC
56
DISPLAY FUEL SUPPLY QUANT
57
DISPLAY PRICE OF FUEL
58
59
SETSW 31 ON ?
YES
NO
60
FLAG = 1
C
61
CUT OFF CURR TO MOTOR 26
A
62
SW 30 RAISE MANIP ?
NO
YES
CUT OFF CURR TO MOTOR 26
63
B

CONTROL SYSTEM FOR CONTROLLING A SUPPLY OF FLUID TO AN INTEGRAL QUANTITY

BACKGROUND OF THE INVENTION

The present invention generally relates to control systems for controlling a supply of fluid to an integral quantity, and more particularly to a control system which is designed to precisely stop the supply of fluid when the quantity of supplied fluid reaches a desired integral quanity after a fluid supplying operation is started. The control system according to the present invention is especially suited for application in a fuel supplying apparatus of a gasoline service station.

Generally, in order to stop the supply of fuel in a fuel supplying apparatus during a fuel supplying operation so that the quantity of fuel which is finally supplied is equal to an integral quantity (for example, 20.00 liters) which is closest to the quantity of supplied fuel at the point when the fuel supplying operation is once stopped, a valve of a fuel supplying nozzle is once closed at a point before the quantity of supplied fuel reaches the integral quantity (for example, when 19.3 liters is supplied) by taking into account the time it takes for the valve of the fuel supplying nozzle to close. Thereafter, a lever of the fuel supplying nozzle is operated while monitoring an indicator so as to supply the fuel in small quantities, and the valve of the fuel supplying nozzle is closed when the integral quantity is reached. However, it is extremely troublesome to stop the supply of fluid when the integral quantity is reached, and such precise stopping of the fuel supplying operation requires skill on the part of the operator. Therefore, there is a disadvantage in that the quantity of supplied fuel may exceed the integral quantity when the operator incorrectly operates the lever of the fuel supplying nozzle.

SUMMARY OF THE INVENTION

Accordingly, it is a general object of the present invention to provide a novel and useful control system for controlling supply of fluid to an integral quantity, in which the above described disadvantage is eliminated.

Another and more specific object of the present invention is to provide a control system for automatically and precisely supplying an integral quantity of fluid. When an operation is performed so as to stop the supply of fluid at the point when the quantity of supplied fluid reaches the integral quantity, the driving of a pump is once interrupted. Thereafter, the pump is repeatedly driven in terms of minute time periods, so that the fluid supplying operation is stopped at the point when the quantity of fluid which is finally supplied is equal to the integral quantity which is closest to a quantity of supplied fluid at the point when the driving of the pump was once interrupted.

Still another object of the present invention is to provide a control system which comprises setting means for setting an integral quantity of fluid at which the supply of fluid is to be stopped during the fluid supplying operation, memory means for pre-storing minimum time periods in which a current is applied to a motor which drives the pump so that the pump supplies one of predetermined small quantities of fluid, and control means. The memory means pre-stores the minimum time periods corresponding to each of the predetermined small quantities of fluid. The control means immediately stops the motor when the setting means is operated, so as to stop the driving of the pump, and sets a target fluid supplying quantity. An integral quantity of fluid which is closest to and is greater than or equal to a quantity of fluid which is measured by measuring means at the point when the motor is stopped, is set as the target fluid supplying quantity. A check is made to confirm that the pump is stopped, and an arithmetic operation is performed to obtain a difference between the target fluid supplying quantity and the quantity of fluid which is measured by the measuring means. A predetermined time period in which the current is applied to the motor, is set based on the minimum time period which is pre-stored in the memory means, so that the difference decreases, and the current is applied to the motor for the predetermined time period so as to drive the pump. The control means repeats the above operation until the difference becomes equal to zero. According to the control system of the present invention, it simply requires the operation of a switch for setting the integral quantity of fluid at which the supply of fluid is to be stopped during the fluid supplying operation, in order to stop the fluid supplying operation at the point when the quantity of supplied fluid is exactly equal to the integral quantity. For this reason, contrary to the conventional case described before, it does not require skill on the part of the operator to supply the integral quantity of fluid. Hence, it is possible to perform the operation of precisely supplying the integral quantity of fluid with ease, and the total price of the supplied fluid can be set so that the total price does not include small money. Further, it is possible to prevent an erroneous operation of supplying a quantity of fluid exceeding the quantity which is desired by the customer.

Other objects and further features of the present invention will be apparent from the following detailed description when read in conjunction with the accompanying drawings.

DETAILED DESCRIPTION

Figure 1:
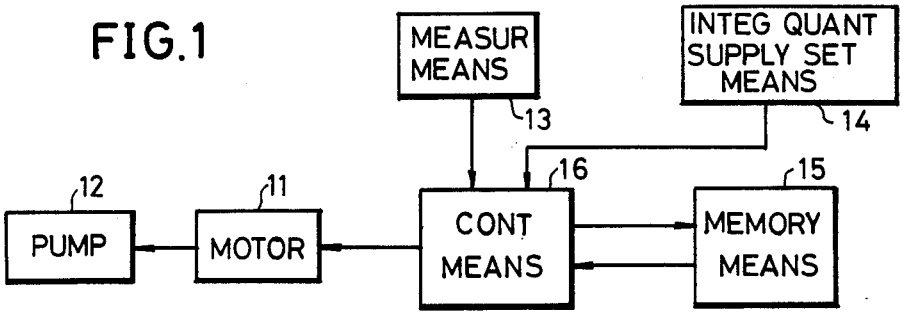
FIG. 1 is a systematic block diagram for generally explaining an embodiment of a control system according to the present invention.

A control system according to the present invention, for supplying an integral quantity of fluid, generally comprises a motor 11, a pump 12 which is driven by the motor 11, measuring means 13 for measuring a flow quantity Q of fluid which is supplied by the pump 12, setting means 14 made up of push-button switches or the like which are disposed in a vicinity of a position where the fuel supplying operation is performed, memory means 15 for pre-storing minimum time periods $t_1$ through $t_n$ in which a current is applied to the motor 11, and control means 16 as shown in FIG. 1, where n is an integer. The setting means 14 sets a target integral quantity P at which the supply of fuel is to be stopped, during a fuel supplying operation. This target integral quantity P is closest to and is greater than or equal to a quantity of fuel which is supplied when the target integral quantity P is set by the setting means 14. In order to supply a predetermined minute flow quantity q of fuel by the pump 12, the memory means 15 pre-stores the minimum time periods $t_1$ through $t_n$ which are in correspondence with each of predetermined minute flow quantities $q_1$ through $q_n$.

Figure 2:
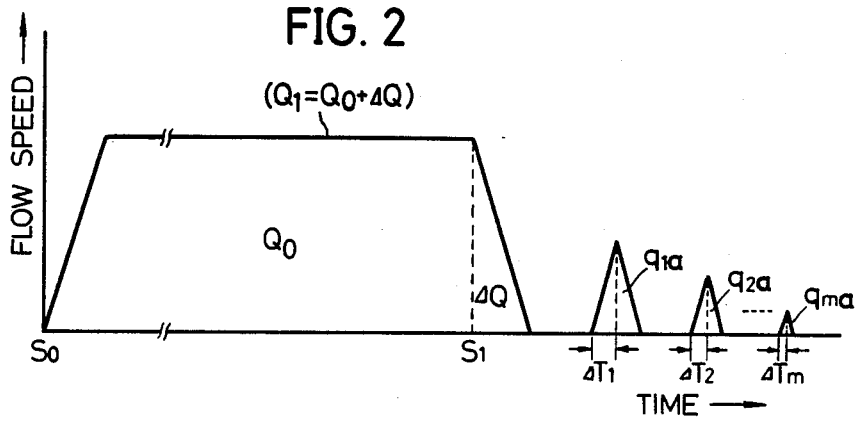
FIG. 2 is a graph showing the relation between the time and the flow speed, for explaining the control operation of the control system according to the present invention.
Figure 5:
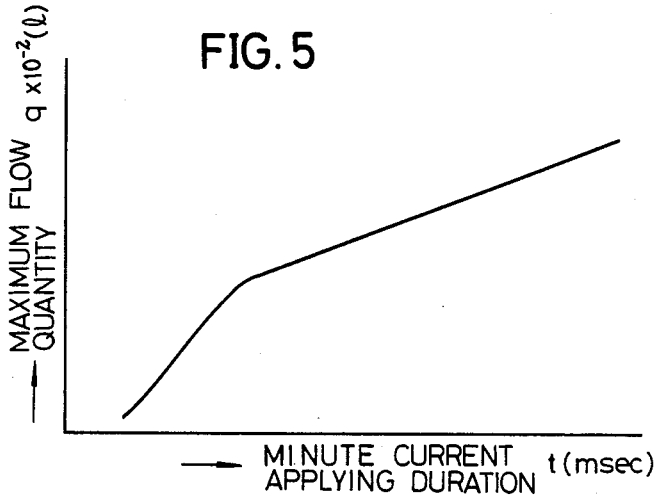
FIG. 5 is a graph showing the relation between a minute current applying time period in which a current is applied to a motor and a maximum flow quantity of the fluid which is supplied by a pump which is driven by the motor.

As shown in FIG. 2, the control means 16 stops applying the current to the motor 11 so as to stop the pump 12, at a point $S_1$ when the setting means 14 is operated. Thereafter, the setting means 14 sets the target integral quantity P which is closest to and is greater than or equal to a measured flow quantity $Q_0$ which is measured by the measuring means 13. The control means 16 confirms that the pump 12 is stopped, and performs an arithmetic operation to obtain a difference $(P-Q_1)$ between the target integral quantity P and a measured flow quantity $Q_1$. The measured flow quantity $Q_1$ is a sum of the flow quantity $Q_0$ which flows from a starting point $S_0$ when the fuel supplying operation is started up to the point $S_1$, and an oversupply quantity $\Delta Q$ which is supplied due to the inertial rotation of the motor 11 and the inertial operation of the pump 12.

The control means 16 selects a flow quantity which corresponds to the difference $(P-Q_1)$, from among the flow quantities $q_1$ through $q_n$ which are pre-stored in the memory means 15, and selects the minimum current applying time period t which corresponds to the selected flow quantity, so as to set a minute current applying time period $\Delta T_1$ in which the current is applied to the motor 11. The motor 11 is applied with the current only for this set minute current applying time period $\Delta T_1$ to drive the pump 12. When the current is applied to the motor 11 for this minute current applying time period $\Delta T_1$, a flow quantity $q_{1a}$ is actually supplied by the pump 12 from the time when the pump 12 starts to operate up to the time when the pump 12 stops to operate under inertia after the current to the motor 11 is cut off. The control means 16 calculates a difference $(P-Q_2)$ between the target integral quantity P and a flow quantity $Q_2$. This flow quantity $Q_2$ is a sum of the flow quantity $Q_1$ which is measured by the measuring means 13 and the flow quantity $q_{1a}$. Similarly, the control means 16 selects and sets a minute current applying time period $\Delta T_2$ in which the current is applied to the motor 11, by using the quantities pre-stored in the memory means 15. The motor 11 is applied with the current only for this minute current applying time period $\Delta T_2$, to drive the pump 12.

Then, similarly as described heretofore, the control means 16 is repeatedly operated m (m is an integer) times until the difference $(P-Q)$ between the measured flow quantity Q which is measured by the measuring means 13 and the target integral quantity P which is set by the setting means 14 becomes zero, that is, until $P \simeq Q$. A predetermined quantity of fluid is supplied with respect to the target integral quantity P, by performing the operations described heretofore.

The preset value P can be described by the following equation.

$$P = Q_0 + \Delta Q + \sum_{n=1}^{m} q_{na}$$

Description will hereinunder be given with respect to a case where the control system according to the present invention is applied to a hanging type fuel supplying apparatus of a fuel supplying station.

Figure 3:
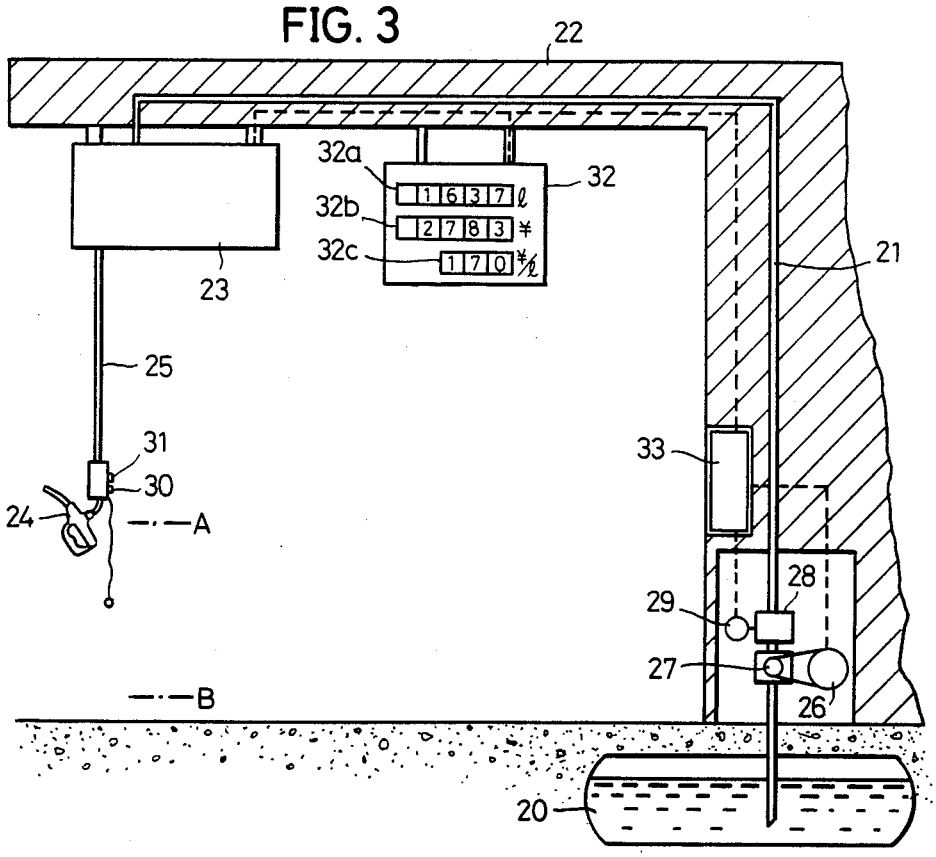
FIG. 3 shows an example of a fuel supplying apparatus which is applied with the control system according to the present invention.

In FIG. 3, one end of a pipe arrangement 21 communicates to an underground tank 20 which stores the fuel. The other end of the pipe arrangement 21 communicates to a fuel supplying hose 25 which has a fuel supplying nozzle 24 at a tip end thereof, through a delivery unit 23 which is provided in a structure 22 located at a high part of the fuel supplying station. A pump 27 which is driven by a pump driving motor 26, and a flowmeter 28 for measuring the fuel supplying quantity, are provided in the pipe arrangement 21. The motor 26 corresponds to the motor 11 shown in FIG. 1, and the pump 27 corresponds to the pump 12 shown in FIG. 1. The flowmeter 28 comprises a flow quantity pulse generator 29 which generates a flow quantity pulse proportional to the flow quantity of the fuel which is measured. The flowmeter 28 and the flow quantity pulse generator 29 together correspond to the measuring means 13 shown in FIG. 1.

An elevator switch 30 and a setting switch 31 are located on the fuel supplying hose 25, in a vicinity of the fuel supplying nozzle 24. The elevator switch 30 drives a hose elevator driving mechanism (not shown) within the delivery unit 23, and raises and lowers the fuel supplying nozzle 24 between a waiting position A where the fuel supplying nozzle 24 does not interfere with a vehicle which enters and leaves the fuel supplying station and a fuel supplying position B which is suited for carrying out the fuel supplying operation with respect to the vehicle. The setting switch 31 corresponds to the setting means 14 shown in FIG. 1, and sets an integral quantity which is closest to and is greater than or equal to the quantity of fuel which is supplied when the integral quantity is set by the setting switch during the fuel supplying operation.

An indicator unit 32 is located within the fuel supplying station, at a position where it is easily visible by an operator. The indicator unit 32 comprises an indicator **32*a* for displaying the quantity of fuel which has been supplied, an indicator 32*b* for displaying the price of fuel which has been supplied, and an indicator 32*c*** for displaying the unit price of fuel.

A control device 33 corresponds to the memory means 15 and the control means 16 shown in FIG. 1. This control device 33 is located at a non-dangerous part within the fuel supplying station.

Figure 4:
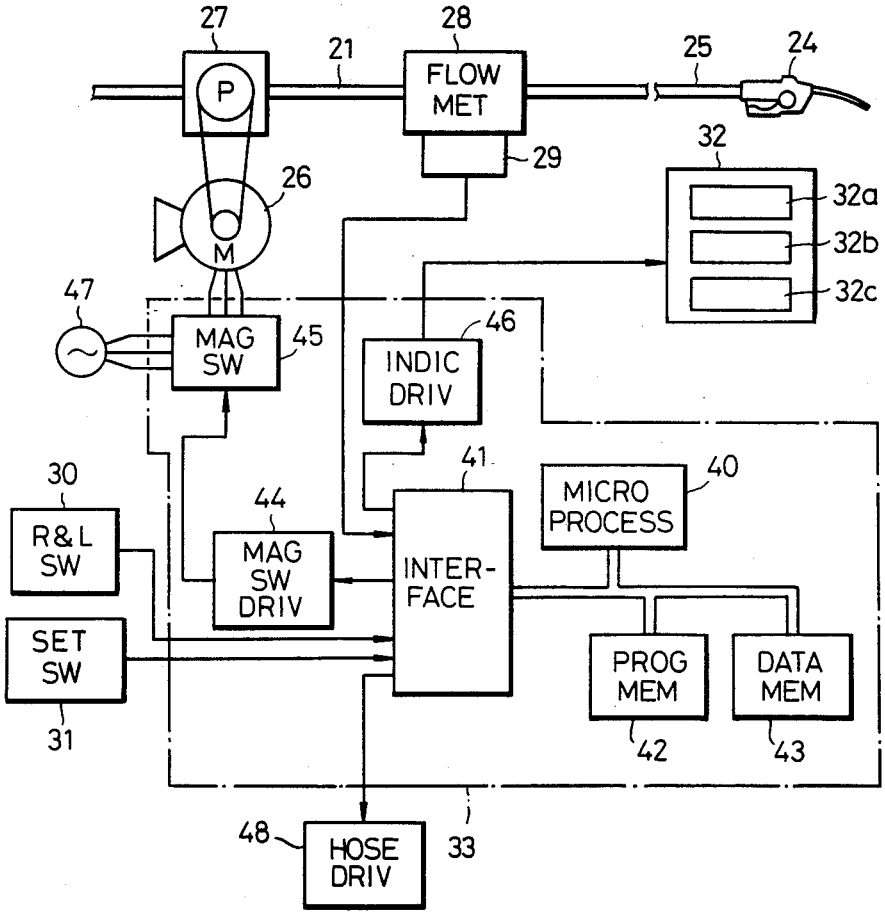
FIG. 4 is a general system diagram showing the fuel supplying apparatus shown in FIG. 3.

Next, description will be given with respect to the system constitution of the fuel supplying apparatus shown in FIG. 3, by referring to FIG. 4. In FIG. 4, those parts which are the same as those corresponding parts in FIG. 3 are designated by the same reference numerals, and their description will be omitted.

The control device 33 comprises a microprocessor 40, an interface 41, a program memory 42, a data memory 43, a magnetic switch driving circuit 44, a magnetic switch 45, and an indicator driving circuit 46. A hose elevator driving mechanism 48 is located within the delivery unit 23.

According to the control contents which are pre-stored in the program memory 42, the microprocessor 40 reads in a manipulation signal from the elevator switch 30 through the interface 41, and drives and controls the hose elevator driving mechanism 48 to raise and lower the fuel supplying nozzle 24. In addition, responsive to the manipulation of the elevator switch 30 and the drive and stoppage of the hose elevator driving mechanism 48, the microprocessor 40 carries out operations such as driving and stopping the motor 26, and resetting the indicators 32*a* and 32*b* of the indicator unit 32 to zero. Moreover, the microprocessor 40 counts the flow quantity pulses which are received from the flow quantity pulse generator 29 through the interface 41, and calculates the quantity Q of fuel which has been supplied and the price of fuel which has been supplied. The calculated quantity Q of fuel which has been supplied and the calculated price of fuel which has been supplied, are supplied to the indicator driving circuit 46 through the interface 41, and the calculated quantity Q of fuel which has been supplied and the price of fuel which has been supplied are respectively displayed on the indicators 32*a* and 32*b*.

Further, according to the control contents which are pre-stored in the program memory 42, the microprocessor 40 reads in a manipulation signal from the setting switch 31 through the interface 41. The microprocessor 40 once stops the motor 26, and sets the target integral quantity P which is closest to and is greater than or equal to the quantity $Q_0$ of fuel which is supplied up to the point when the setting switch 31 is manipulated.

When the fuel supplying operation is started, the microprocessor 40 supplies a control signal to the magnetic switch driving circuit 44 through the interface 41, according to the control contents which are pre-stored in the program memory 42. The magnetic switch 45 is turned ON or OFF responsive to the control signal which is supplied to the magnetic switch driving circuit 44 from the microprocessor 40, so as to pass or cut off the application of a current from a power source 47 to the motor 26. In addition to the preset data, the minimum current applying time period t in which the current is applied to the motor 26 so as to supply the minute flow quantity q by the pump 27, is also pre-stored in the data memory 43. The minimum current applying time period t is pre-stored in the data memory 43 as data having the minute flow quantity q as the index, as shown in the following table. The minimum current applying time period t is determined based on the flow quantity $q_a$ which includes the oversupply quantity $\Delta q_a$ supplied by the pump 27 when the current is applied to the motor 26 for the minute current applying time period $\Delta T$, that is, when the pump 27 is driven for the time period $\Delta T$.

TABLE

| Flow Quantity q (liters) | time period t (msec) |
|---|---|
| $q_1 \times 10^{-2}$ | $t_1$ |
| $q_2 \times 10^{-2}$ | $t_2$ |

TABLE-continued

| Flow Quantity q (liters) | time period t (msec) |
|---|---|
| $q_3 \times 10^{-2}$ | $t_3$ |
| $q_4 \times 10^{-2}$ | $t_4$ |
| $q_n \times 10^{-2}$ | $t_n$ |

Figure 6:
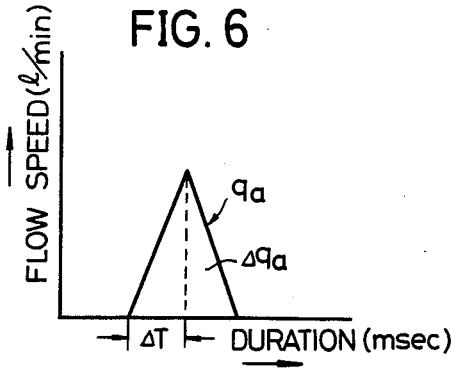
FIG. 6 is a graph showing the relation between the minute current applying time period in which the current is applied to the motor and a flow speed of the fluid which is supplied by the pump.

FIG. 6 shows the flow quantity $q_a$ which includes the oversupply quantity $\Delta q_a$ supplied by the pump 27 when the current is applied to the motor 26 for the minute current applying time period $\Delta T$ and thereafter cut off.

Next, description will be given with respect to the operation of the fuel supplying apparatus when supplying an integral quantity fuel, by referring to the flowchart of FIGS. 7A and 7B.

Figure 7A:
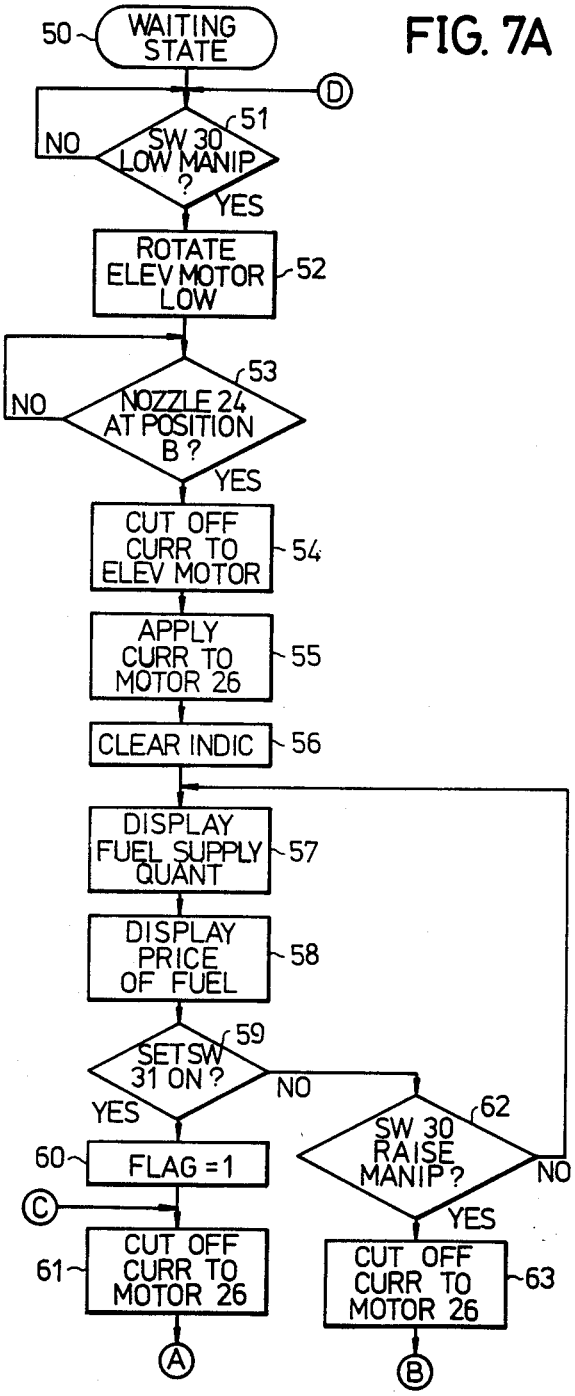
FIGS. 7A and 7B are flowcharts for explaining the operation of a microprocessor within the system shown in FIG. 4.
Figure 7B:
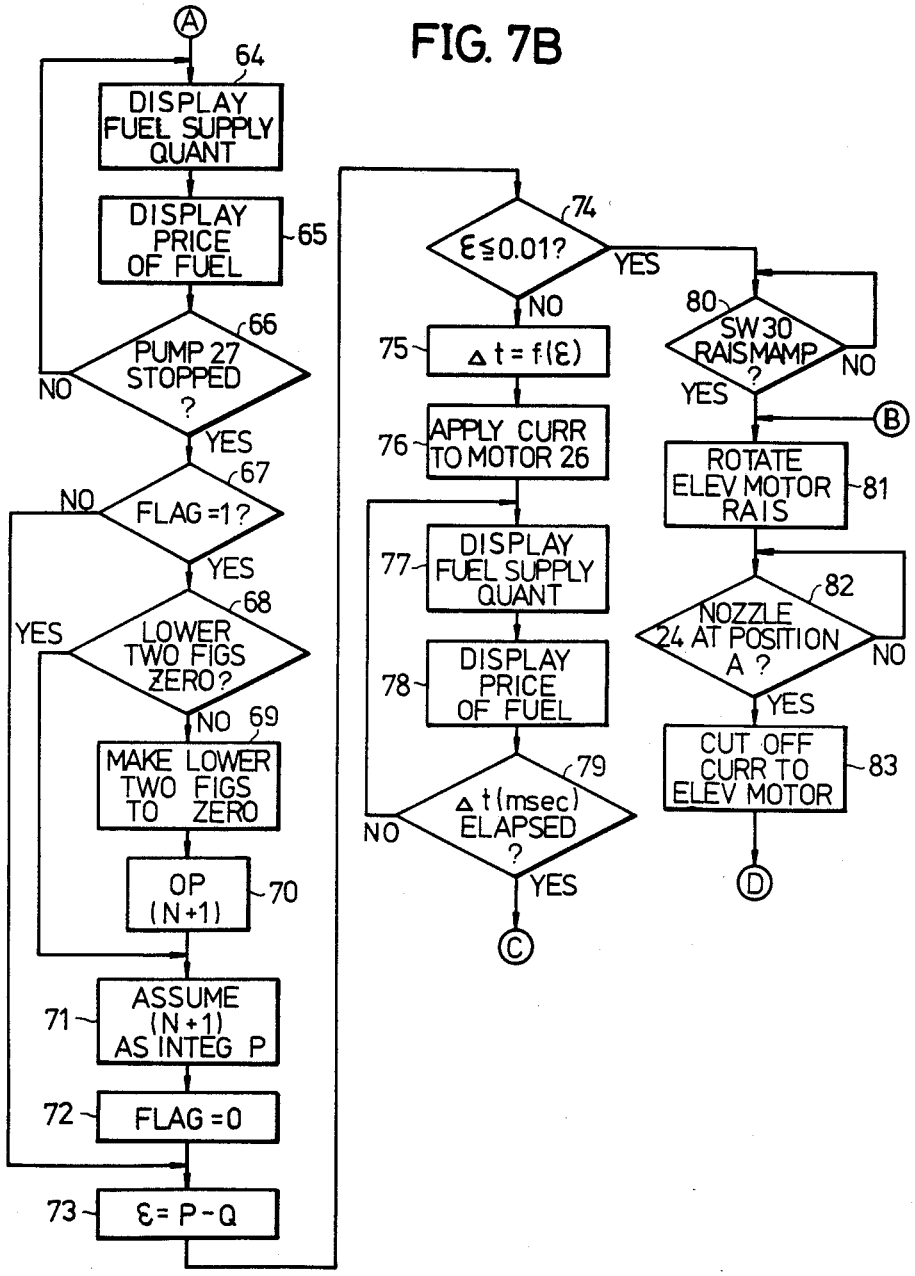

When the fuel supplying nozzle 24 is in the waiting position A shown in FIG. 3, the microprocessor 40 perform a step 50 shown in FIG. 7A. In the step 50, the quantity of supplied fuel, the price of the supplied fuel, and the unit price of the fuel which are with respect to a previous fuel supplying operation and are stored in the data memory 43, are supplied from the microprocessor 40 to the respective indicators 32*a*, 32*b*, and 32*c* of the indicator unit 32, through the interface 41 and the indicator driving circuit 46. Thus, the quantity of supplied fuel, the price of the supplied fuel, and the unit price of the fuel, are displayed on the respective indicators 32*a*, 32*b*, and 32*c*.

When the operator manipulates and closes the elevator switch 30 so as to lower the fuel supplying nozzle 24 from the waiting position A to the fuel supplying position B, the microprocessor 40 reads in the manipulation signal from the elevator switch 30 through the interface 41 in a step 51. In a subsequent step 52, the microprocessor 40 rotates a hose elevator motor (not shown) of the hose elevator driving mechanism 48 so that the fuel supplying hose 25 is fed out. In a step 53, the microprocessor 40 discriminates through the interface 41, whether a fuel supplying position detection signal from a position detecting device (not shown) which is made up of a cam switch or the like within the hose elevator driving mechanism 48. In other words, in the step 53, the microprocessor 40 discriminates whether the fuel supplying nozzle 24 is lowered to the fuel supplying position B. When the discrimination result in the step 53 is YES, the microprocessor 40 cuts off the application of the current to the hose elevator motor and produces a switch closing signal in a step 54. This switch closing signal is supplied to the switch driving circuit 44 through the interface 41, so as to close the magnetic switch 45. In a step 55, the microprocessor 40 supplies the current from the power source 47 to the motor 26 and rotates the motor 26. Further, in a step 56, the microprocessor 40 resets the indicators 32*a* and 32*b* to zero through the interface 41 and the indicator driving circuit 46.

Next, when the operator inserts the fuel ejecting pipe of the fuel supplying nozzle 24 into the fuel supplying opening of the vehicle and opens the valve of the fuel supplying nozzle 24 so as to start the fuel supplying operation, the fuel from the underground tank 20 is supplied successively through the pipe arrangement 21, the pump 27, the flowmeter 28, the delivery unit 23, and the fuel supplying hose 25. As a result, the microprocessor 40 reads in and counts the flow quantity pulses generated from the flow quantity pulse generator 29, through the interface 41, and calculates the quantity Q of supplied fuel and the price of the supplied fuel. For example, the flow quantity pulse generator 29 generates one flow quantity pulse every time the measured flow quantity in the flowmeter 28 reaches 0.01 liters. In a step 57, the microprocessor 40 supplies the calculated quantity Q of supplied fuel to the indicator 32*a* through the interface 41 and the indicator driving circuit 46, so as to display the quantity Q on the indicator 32*a*. In addition, in a step 58, the microprocessor 40 supplies the calculated price of supplied fuel to the indicator 32*b* through the interface 41 and the indicator driving circuit 46, so as to display the price of supplied fuel on the indicator 32*b*.

As the fuel supplying operation progresses and a certain liters of fuel is supplied, the customer may request that the fuel supplying operation be stopped when the quantity of supplied fuel reaches an integral quantity. In this case, the operator closes the setting switch 31. In a step 59, the microprocessor 40 discriminates whether the setting switch 31 is ON, by reading in the manipulation signal from the setting switch 31 through the interface 41. The discrimination result in the step 59 is YES when the setting switch 31 is closed as described above, and the mode of the fuel supplying apparatus is changed to an integral quantity supplying mode. As a result, the microprocessor 40 sets a flag within a data region thereof to "1", in a step 60. This flag is used as an internal instruction for starting the operation of controlling the supply of fuel to an integral quantity.

When the switch 31 is not closed and the discrimination result in the step 59 is NO, the operator closes the valve of the fuel supplying nozzle 24 when the quantity of supplied reaches a desired quantity. The operator removes the fuel ejecting pipe of the fuel supplying nozzle 24 from the fuel supplying opening of the vehicle, and operates the elevator switch 30 so as to raise the fuel supplying nozzle 24 up to the waiting position A. In this case, the discrimination result in a step 62 is YES, and the application of the current to the motor 26 is cut off in a step 63. The operation then advances to a step 81 shown in FIG. 7B as indicated by a symbol " B ".

On the other hand, when the discrimination result in the step 59 is YES and the flag is set in the step 60, the microprocessor 40 performs a step 61. In the step 61, the microprocessor 40 supplies an opening signal to the magnetic switch driving circuit 44 through the interface 41, so as to open the magnetic switch 45 and cut off the supply of current from the power source 47 to the motor 26.

Due to the inertial operation of the pump 27 and the inertia of the flowing fuel, the flow quantity pulse generator 27 continues to generate the flow quantity pulses corresponding to the oversupply quantity $\Delta Q$ even after the supply of the current to the motor 26 is cut off. Thus, the microprocessor 40 also reads in and counts these flow quantity pulses corresponding to the oversupply quantity $\Delta Q$, and calculates the quantity Q of supplied fuel and the price of supplied fuel. Then the operation advances to a step 64 shown in FIG. 7B, as indicated by a symbol " A ". The microprocessor 40 performs the step 64 so as to display the quantity Q on the indicator 32*a*, and performs a step 65 so as to display the price of supplied fuel on the indicator 32*b*.

In addition, every time the microprocessor 40 reads in the flow quantity pulses which correspond to the oversupply quantity $\Delta Q$ and are generated from the flow quantity pulse generator 29, the microprocessor 40 counts output clock pulses of an internal timer (not shown). When a counted value of the clock pulses becomes equal to a predetermined value which is prestored in the data memory 43, the microprocessor 40 discriminates in a step 66 that the pump 27 has stopped, and the operation advances to a step 67.

In the step 67, the microprocessor 40 discriminates whether the flag is equal to "1". When the flag is equal to "1" and the discrimination result in the step 67 is YES, a step 68 discriminates whether the lower two figures after the decimal point in the quantity Q are zero. When the discrimination result in the step 68 is NO, a step 69 makes the lower two figures after the decimal point in the quantity Q equal to zero. A step 70 subsequent to the step 69, performs an arithmetic operation of (N+1), where N is an integer which is equal to the quantity Q with the lower two figures after the decimal point omitted. A step 71 sets the value (N+1) as the target integral quantity P. The microprocessor 40 makes the flag equal to "0" within the data region thereof in a step 72, which means that the setting of the target integral quantity is completed. A step 73 is performed subsequent to the step 72. On the other hand, when the lower two digits after the decimal point in the quantity Q are zero and the discrimination result in the step 68 is YES, the operation advances to the step 71 to set this quantity Q as the target integral quantity P. Further, when the flag is equal to "0" and the discrimination result in the step 67 is NO, the operation directly advances to the step 73 because the setting of the target integral quantity is already completed in this case. After the flag is made equal to "0", the target integral quantity P will not be renewed.

Next, in the step 73, the microprocessor 40 subtracts the quantity Q of supplied fuel at the point when the pump 27 is stopped, from the target integral quantity P, so as to obtain a difference $\epsilon$. A step 74 discriminates whether the difference $\epsilon$ is less than or equal to 0.01 liters. In other words, the step 74 discriminates whether the generating accuracy of the flow quantity pulse generator 29 is less than or equal to 0.01 liters, or whether the quantity Q of supplied fuel exceeds the target integral quantity P.

When the difference $\epsilon$ is greater than 0.01 liters (that is, when $P-Q \geqq 0.01$), the discrimination result in the step 74 is NO, the microprocessor 40 performs a step 75. As described before, the data memory 43 pre-stores the minimum current applying time period $t_n$ ($n=1, 2, \ldots$) with respect to the motor 26 so as to supply the minute quantity q of fuel. In the step 75, the microprocessor 40 uses the difference $\epsilon$ as the index and reads out a minimum current applying time period which reduces the difference $\epsilon$ and is most closely related to $\Delta t=f(\epsilon)$, from among the minimum current applying time periods $t_n$ (where $n=1, 2, \ldots$) which are pre-stored in the data memory 43. The microprocessor 40 reads out a minimum current applying time period $t_i$, for example, and stores this time period $t_i$ in the data memory 43, as a current applying time period $\Delta t$ with respect to the motor 26. The microprocessor 40 again closes the magnetic switch 45 and applies the current to the motor 26 in a step 76.

Accordingly, the pump 27 is driven and the flow quantity pulses are generated from the flow quantity pulse generator 29. The microprocessor 40 calculates the quantity Q of supplied fuel and the price of supplied fuel from the flow quantity pulses as described before. The microprocessor 40 displays the calculated quantity Q of supplied fuel on the indicator 32*a* in a step 77, and displays the calculated price of supplied fuel on the indicator 32b in a step 78.

At the same time as when the magnetic switch 45 is closed, the microprocessor 40 counts the output clock pulses of the internal timer so as to measure the current applying time period Δt with respect to the motor 26. In a step 79, the microprocessor 40 compares the measured time period Δt with the minimum current applying time period $t_i$ which is stored in the data memory 43, and discriminates whether the time period Δt has elapsed.

When the current applying time period Δt with respect to the motor 26 becomes equal to the minimum current applying time period $t_i$, the microprocessor 40 supplies an opening signal to the magnetic switch driving circuit 44, and the operation returns to the step 61 shown in FIG. 7A as indicated by a symbol " C ". The magnetic switch 45 is opened and the application of the current to the motor 26 is cut off in the step 61.

Even after the fuel supplying operation performed by the steps 73 through 79 is completed and the application of the current to the motor 26 is cut off, the pump 27 continues to operate due to inertia and the fuel continues to flow. Hence, the flow quantity pulse generator 29 continues to generate the flow quantity pulses. The microprocessor 40 also reads in and counts these flow quantity pulses corresponding to the oversupply quantity, and calculates the quantity Q of supplied fuel and the price of supplied fuel. The calculated quantity Q of supplied fuel is displayed on the indicator 32a in the step 64, and the calculated price of supplied fuel is displayed on the indicator 32b in the step 65. The quantity Q of supplied fuel, including the oversupply quantity which is supplied after the application of the current to the motor 26 is cut off, will not exceed the target integral quantity P by over 0.01 liters which is the measuring accuracy of the flow quantity pulse generator 29. This is because the current applying time period Δt is set to the minimum current applying time period t with respect to the motor 26, including the oversupply quantity which reduces the difference between the target integral quantity P and the quantity Q of supplied fuel.

As described before, the application of the current to the motor 26 under the control of the microprocessor 40, is repeatedly performed an appropriate number of times until the step 74 discriminates that the difference ε between the quantity Q of supplied fuel and the target integral quantity P is less than or equal to 0.01 liters.

On the other hand, when the difference ε between the quantity Q of supplied fuel and the target integral quantity P becomes less than or equal to 0.01 liters, the motor 26 and the pump 27 stop operating, and the fuel supplying operation with respect to the target integral quantity P is completed, the operator closes the valve of the fuel supplying nozzle 24 and removes the ejecting pipe of the fuel supplying nozzle 24 out of the fuel supplying opening of the vehicle. When the elevator switch 30 is manipulated so as to raise the fuel supplying nozzle 24, the microprocessor 40 detects the output manipulation signal of the elevator switch 30 and discriminates in a step 80 that the elevator switch 30 is manipulated to raise the fuel supplying nozzle 24. That is, the discrimination result in the step 80 is YES in this case, and the operation advances to the step 81. The microprocessor 40 rotates the elevator motor of the hose elevator mechanism 48 in the reverse direction, so as to raise the fuel supplying nozzle 24. In a step 82, the microprocessor 40 discriminates whether the fuel supplying nozzle 24 is returned to the waiting position A, according to the output signal of the position detecting device of the hose elevator mechanism 48. When the discrimination result in the step 82 is YES, the microprocessor 40 cuts off the application of the current to the elevator motor in a step 83. Subsequent to the step 83, the operation returns to the step 51 shown in FIG. 7A as indicated by a symbol " D ", so as to prepare for the next fuel supplying operation.

Next, the operation of supplying integral quantity of fuel, will now be described by giving specific numerical values. It will be assumed that the setting switch 31 is manipulated and closed after 19.80 liters of fuel is supplied from the start of the fuel supplying operation. In this case, the step 59 discriminates that the setting switch 31 is closed, and the application of the current to the motor 26 is once cut off in the step 61. However, even after the current to the motor 26 is cut off, the pump 27 continues to operate due to inertia, and the oversupply quantity is supplied. For example, it will be assumed that the oversupply quantity Q is equal to 0.10 liters. In this case, the quantity Q of supplied fuel becomes equal to 19.90 liters. In the step 66, the microprocessor 40 checks to confirm that the oversupply quantity of 0.10 liters is supplied and that the pump 27 is stopped. Then, in the step 67, the microprocessor 40 discriminates whether the flag is equal to "1". When the flag is equal to "1" and the discrimination result in the step 67 is YES, the microprocessor 40 performs the step 69 so as to make the lower two figures after the decimal point in the quantity of 19.90 liters to zero, that is, to make 0.90 in the quantity of 19.90 liters to zero. In other words, the lower two figures after the decimal point in the quantity of 19.90 liters is omitted, to obtain a value 19.00 in the step 69. In the step 70, the microprocessor 40 performs the arithmetic operation of (N+1), where N is equal to the value 19.00 obtained in the step 69, so as to obtain a value of 20.00. In the step 71, the microprocessor 40 sets the target integral quantity P to the value of 20.00 obtained in the step 70.

In the step 73, the microprocessor 40 subtracts the quantity Q of supplied fuel which is 19.90 liters, from the target integral quantity P which is 20.00 liters, to obtain the difference ε which is equal to 0.10 liters. Among the minimum current applying time periods t with respect to the motor 26 pre-stored in the data memory 43, the microprocessor 40 calculates and reads out the current applying time period Δt which is most closely related to Δt=f(0.10). When it is assumed that the read out current applying time period Δt is equal to 90 msec, for example, the current is again applied to the motor 26 for the time of 90 msec. As a result of this driving of the motor 26 for the time of 90 msec, 0.09 liters of fuel is actually supplied including the oversupply quantity, and the total quantity of supplied fuel reaches 19.99 liters.

However, in this case, the total quantity Q of supplied fuel which is 19.90 liters, is less than the target integral quantity P of 20.00 liters, by a quantity of 0.01 liters. Thus, the operation described above is repeated in this case. In other words, the target integral quantity P of 20.00 liters is obtained in the steps 67 through 71, and the difference ε of 0.01 liters is obtained by calculating (P−Q). Then, among the minimum current applying time periods t with respect to the motor 26 pre-stored in the data memory 43, the microprocessor 40 calculates and reads out the current applying time period Δt which is most closely related to Δt=f(0.01). When it is assumed that this current applying time period Δt which is read out is equal to 20 msec, the current is again applied to the motor 26 only for this time of 20 msec.

When the current is applied to the motor 26 for this time of 20 msec, the total quantity Q of supplied fuel becomes essentially equal to 20.00 liters including the oversupply quantity due to the inertial operation of the pump 27. The difference $\epsilon$ between the target integral quantity P and the actual quantity Q of supplied fuel becomes less than 0.01 liters, and the fuel supply of exactly the target integral quantity P of 20.00 liters is completed.

In the embodiment described heretofore, the control system according to the present invention is applied to a hanging type fuel supplying apparatus of a fuel supplying station. However, the application of the control system according to the present invention is not limited to this hanging type fuel supplying apparatus, and the present invention may be applied to a system for shipping a constant quantity of fluid in a fluid shipping plant, an apparatus for supplying liquefied petroleum gas (LPG), or the like.

Further, the present invention is not limited to these embodiments, but various variations and modifications may be made without departing from the scope of the present invention.

What is claimed is:

1. A control system for controlling a supply of fluid to an integral quantity, said control system comprising:

a pump for supplying a fluid;

a motor rotated responsive to an application of a current applied thereto, for driving said pump;

measuring means for measuring a flow quantity of the fluid which is supplied by said pump;

setting means set during a fluid supplying operation, for stopping the supply of fluid when a quantity of supplied fluid reaches an integral quantity;

memory means for pre-storing minimum current applying time periods in which a current is applied to said motor so as to supply predetermined minute quantities of the fluid, said minimum current applying time periods being in correspondence with each of said predetermined minute quantities; and control means for cutting off the current to said motor responsive to the setting of said setting means, said control means setting as a target integral value an integral value which is closest to and is greater than or equal to a flow quantity measured by said measuring means after said pump is stopped, checking to confirm that said pump is stopped and calculating a difference between said target integral value and the flow quantity measured by said measuring means, selectively setting a current applying time period with respect to said motor so as to reduce said difference based on the minimum current applying time periods pre-stored in said memory means, applying the current to said motor so as to drive said pump for said current applying time period, and repeating the sequence of operations until said difference between said target integral value and the flow quantity measured by said measuring means becomes substantially equal to zero.

2. A control system as claimed in claim 1 in which an equation:

$$P = Q_0 + \Delta Q + \sum_{n=1}^{m} q_{na}$$

stands, where P represents said target integral value, $Q_0$ represents the quantity of fluid supplied up to the point when said setting means is set, $\Delta Q$ represents an oversupply quantity of fluid which is supplied after said setting means is set, and $q_{na}$ represents said minimum current applying time periods.

3. A control system as claimed in claim 1 in which said current applying time period is selected to a value so that said motor does not reach a steady state rotation.

4. A control system as claimed in claim 3 in which said current applying time period decreases as the number of times the current is applied to said motor increases.

* * * * *